US007955349B2

(12) United States Patent
Reil

(10) Patent No.: US 7,955,349 B2
(45) Date of Patent: Jun. 7, 2011

(54) BODY PIERCING INSTRUMENT

(76) Inventor: Vladimir Reil, Ranch Palos Verdes, CA (US)

( * ) Notice: Subject to any disclaimer, the term of this patent is extended or adjusted under 35 U.S.C. 154(b) by 1314 days.

(21) Appl. No.: 10/863,681

(22) Filed: Jun. 8, 2004

(65) Prior Publication Data

US 2005/0273128 A1 Dec. 8, 2005

(51) Int. Cl.
*A61B 17/34* (2006.01)

(52) U.S. Cl. ..... 606/188; 606/117

(58) Field of Classification Search ..... 606/185–188, 606/117; 63/12; 227/46, 92; 29/525.06
See application file for complete search history.

(56) References Cited

U.S. PATENT DOCUMENTS

| | | | | |
|---|---|---|---|---|
| 3,707,258 | A * | 12/1972 | Schlitt | 228/52 |
| 3,945,089 | A | 3/1976 | Gagnon | |
| 4,146,032 | A | 3/1979 | Rubenstein et al. | |
| 4,184,343 | A | 1/1980 | Green | |
| 4,195,492 | A | 4/1980 | Johnson | |
| 4,214,456 | A | 7/1980 | Hannum | |
| 4,259,850 | A | 4/1981 | Lalieu | |
| 4,397,067 | A | 8/1983 | Rapselk | |
| 4,474,572 | A * | 10/1984 | McNaughton et al. | 604/61 |
| 4,527,563 | A * | 7/1985 | Reil | 606/188 |
| 4,631,929 | A | 12/1986 | Hollingworth | |
| 4,907,425 | A | 3/1990 | Elkin | |
| 5,004,471 | A | 4/1991 | Mann | |
| 5,140,840 | A | 8/1992 | Micell | |
| 5,154,068 | A | 10/1992 | DiDomenico | |
| 5,201,197 | A | 4/1993 | Bakker | |
| 5,395,381 | A * | 3/1995 | Green et al. | 606/143 |
| 5,454,829 | A | 10/1995 | Koland | |
| 5,456,094 | A | 10/1995 | Greenwald | |
| D366,316 | S | 1/1996 | Rell | |
| 5,496,343 | A * | 3/1996 | Reil | 606/188 |
| 5,499,993 | A | 3/1996 | Blomdahl et al. | |
| 5,588,309 | A | 12/1996 | Chioffe | |
| 5,632,163 | A | 5/1997 | Inoue | |
| D384,302 | S | 9/1997 | Reil | |

(Continued)

FOREIGN PATENT DOCUMENTS

EP 0 092 408 A2 * 10/1983

(Continued)

OTHER PUBLICATIONS

International Search Report for PCT/US 01/42754.

*Primary Examiner* — Todd E Manahan
*Assistant Examiner* — Kathleen Sonnett
(74) *Attorney, Agent, or Firm* — Canady & Lortz LLP; Bradley K. Lortz

(57) ABSTRACT

Apparatuses and methods for a ornamental piercing of body parts are disclosed. An exemplary a piercing instrument includes a post carrier disposed to translate in a first channel within the body piercing instrument, a nut carrier disposed to translate in second channel within the body piercing instrument in opposition to translation of the post carrier and a synchronizing mechanism between the post carrier and the nut carrier to coordinate opposing motion relative to the body piercing instrument of both the post carrier and the nut carrier simultaneously. The synchronizing mechanism can be a gear, where the post and nut carriers include racks that engage the gear. The body piercing instrument can be hand-operated and also include a stabilizing surface to support the body part to be pierced during operation.

27 Claims, 14 Drawing Sheets

U.S. PATENT DOCUMENTS

| | | | | | |
|---|---|---|---|---|---|
| 5,675,987 | A | | 10/1997 | Nakajima | |
| 5,709,700 | A | * | 1/1998 | Hirota | 606/188 |
| D392,042 | S | | 3/1998 | Reil | |
| 5,743,113 | A | | 4/1998 | Kogen | |
| 5,792,170 | A | | 8/1998 | Rell | |
| 5,868,774 | A | | 2/1999 | Rell | |
| 6,036,712 | A | | 3/2000 | Blomdahl | |
| 6,099,545 | A | * | 8/2000 | Mann et al. | 606/188 |

FOREIGN PATENT DOCUMENTS

| | | | |
|---|---|---|---|
| EP | 0761119 | A1 | 12/1997 |
| GB | 2149305 | A | 10/1983 |
| JP | 08322615 | | 12/1996 |
| JP | 09224722 | | 9/1997 |
| JP | 08196313 | | 8/1998 |

* cited by examiner

BODY PIERCING INSTRUMENT

BACKGROUND OF THE INVENTION

1. Field of the Invention

The present invention relates to apparatuses and methods for ornamental piercing of body parts. Particularly, the present invention relates to apparatuses and methods for a hand-operated body piercing instrument.

2. Description of the Related Art

In recent years, body piercing has become an increasingly common practice in the U.S. and throughout the world. The practice is rapidly becoming a routine procedure, often performed by laypersons without medical experience or training. Presently, a number of manually operated devices are available that allow for the safe, hygienic, user-friendly piercing of body parts. Examples of such systems are disclosed in U.S. Pat. No. 5,496,343 issued to Reil on Mar. 5, 1996, U.S. Pat. No. 5,792,170 issued to Reil on Aug. 11, 1998, U.S. Pat. No. 5,868,774 issued to Reil on Feb. 9, 1999, U.S. Pat. No. 6,599,306 issued to Reil on Jul. 29, 2003 and U.S. patent application Ser. No. 09/929,508 by Reil, filed Aug. 14, 2001, all of which are incorporated by reference herein.

The various piercing systems that exist today essentially comprise a stud (also called an earring or a piercing earring) with a post (also called a pin or a piercing pin) and a nut (sometimes called a clasp) that are mounted in a cartridge. During the piercing process, the body part (e.g. an ear lobe) is placed between the post and the nut and the cartridge is squeezed, either manually or by placing it in a stud gun, which causes the post to pierce the body part and engage the nut.

Some existing ear-piercing cartridges suffer from a number of drawbacks. For example, repeatable control of the piercing process is extremely important. However, many piercing instruments can be erratic, particularly when the technician is unskilled. To illustrate, the use of the frangible tab in the '744 patent, mentioned above, leads to only discrete control over the ear piercing process. When the earring assembly is squeezed, either holding it in a hand or mounted in an ear piercing instrument, the presence of the frangible tab implies that once the earring assembly is squeezed to the point of breaking the tab, the ear is pierced automatically. Thus, it prevents continuous control of the exact location and timing of the ear-piercing process. Because of the lack of continuous control over the location and timing of the ear-piercing process, the technician who is piercing the ear must use some guesswork to line the stud post with the desired piercing area. Occasionally, this causes the technician to miss the exact location for the piercing. Many other piercing instruments also operate with a snap action that makes errors more likely.

Furthermore, in conventional body piercing instruments, there are two moving halves, one half carrying the post and the other half carrying the nut. The handle or grip of the instrument is attached to one of these halves (usually the post), while the lever or trigger is attached to the other half (usually the nut). Thus, both halves are generally in motion when the piercing is performed. As a consequence, the operation of such instruments can be less stable than needed to assure an accurate and repeatable piercing.

In view of the foregoing, there is a need for body piercing systems and methods that provide for simple, accurate, repeatable and safe piercing. Further, there is a need for such designs to be made compatible with existing systems, minimizing additional and separate components and mechanisms. As discussed hereafter, the present invention meets these and other needs.

SUMMARY OF THE INVENTION

Apparatuses and methods for a ornamental piercing of body parts are disclosed. Embodiments of the present invention provide a higher level of accuracy for piercing even when handled by persons without a high degree of training or skill. In particular, the present invention seeks to provide an piercing instrument that can be finely controlled throughout the procedure by the operator. The operator need not commit to piercing until certain of piercing the precise desired location.

An exemplary piercing instrument of the invention includes a post carrier disposed to translate in a first channel within the body piercing instrument, a nut carrier disposed to translate in second channel within the body piercing instrument in opposition to translation of the post carrier and a synchronizing mechanism between the post carrier and the nut carrier to coordinate opposing motion relative to the body piercing instrument of both the post carrier and the nut carrier simultaneously. Thus, the instrument operates with a simultaneous two-way motion, the post carrier pushes in one direction and the nut carrier draws in the opposite direction relative to the instrument handle. The synchronizing mechanism can be a single gear, where the post and nut carriers include gear racks that engage the gear on opposite sides.

The body piercing instrument can be hand-operated and functions to provide a very controlled piercing operation, avoiding the snap action which can result in errors in the operation of many conventional piercing instruments. Furthermore, embodiments of the invention may also include a stabilizing surface to support the body part to be pierced during operation. The piercing instrument is placed in stable contact with the body part to be pierced before operation of the instrument. The precise location of the intended piercing can be shown with an indicator on the stabilizing surface (e.g. a passage for the post to pass through). This further enhances to the precision and control of the operation of the instrument.

In still further embodiments of the invention, the instrument can be constructed to be loaded with individual sterile nut and post (with stud). In alternate embodiments, the instrument can be constructed to be loaded with the nut and post carried in a single sterile cartridge. Furthermore, embodiments of the invention can be designed to operate with any type of nut and stud used in piercing instruments. For example, embodiments of the invention may use a conventional stud or a hinged hoop earring.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration specific embodiments in which the invention may be practiced. It is to be understood that other embodiments may be utilized and structural changes may be made without departing from the scope of the present invention. For example, it should be noted that although embodiments of the piercing instrument are described hereafter in the context of ear piercing, the invention is not limited to ear piercing; the piercing instrument may also be employed in piercing many other body parts as is known in the art.

1.0 Overview

As discussed above, embodiments of the present invention comprise a body piercing instrument that provides for stable and precise operation. The invention provides synchronized motion of both the post and nut in the piercing process. In addition, a stabilizing surface can be provided to enhance stable operation of the piercing instrument. The stabilizing surface may also provide a precise indicator of the piercing location.

Figure 1:
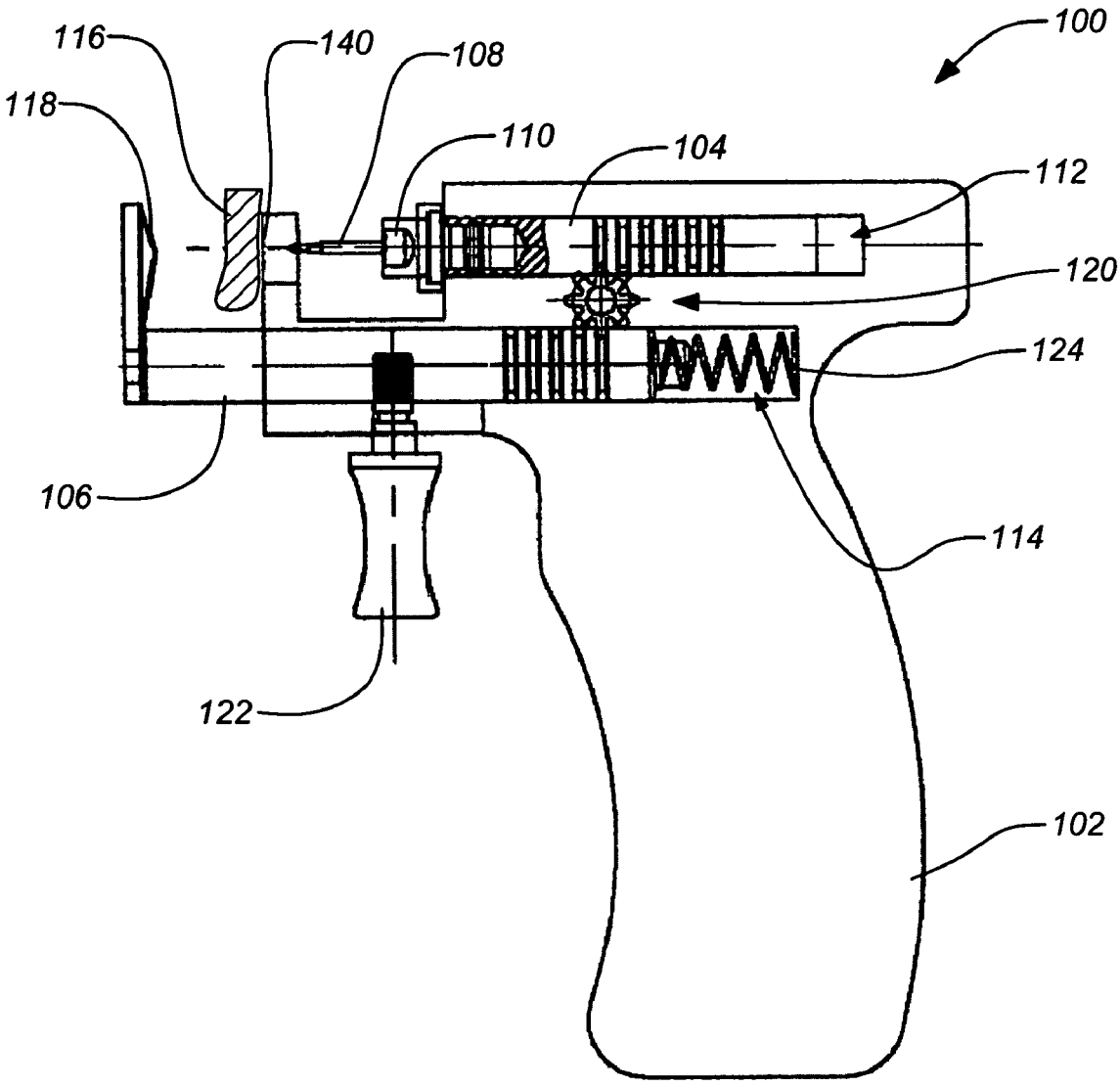
FIG. 1 illustrates an exemplary embodiment of a piercing instrument in an open position according to the invention.

FIG. 1 illustrates an exemplary embodiment of a piercing instrument 100 in an open position according to the invention. The piercing instrument 100 includes a handle 102 which serves as the stable platform that is manually manipulated by the user and houses the piercing mechanism. The handle 102 may be a single unit (e.g. a single molded plastic piece) or comprise multiple parts fastened together. In any case, all elements of the handle 102 are in a fixed relationship together and independent from the primary moving parts of the post carrier 104 and the nut carrier 106.

The post carrier 104 supports a post 108, the portion of the piercing ornament that is driven through the body part 116 during the piercing operation. In a typical piercing, the ornamental portion of the pierced object is a decorative stud 110 fixed to the end of the post 108. Embodiments of the present invention can employ such conventional posts with studs or other forms of ornamental hardware. For example, embodiments of the invention can be designed to operate with the hinged hoop earring described in Ser. No. 09/929,508 by Reil, filed Aug. 14, 2001, which is incorporated by reference herein.

The post carrier 104 is disposed to translate in a first channel 112 within the handle 102 of the body piercing instrument 100. The first channel 112 operates as a guide for the motion of the post carrier 104. As depicted in FIG. 1, the first channel 112 is a substantially cylindrical hollow in the handle 102 and the post carrier 104 comprise a matching substantially cylindrical shape that is slidably engaged with the first channel 112. However, any other guide mechanism known in the art may also be used. For example, in other embodiments a C-rail and track or other shaped rails and tracks may be used. In addition, if desired a keyway can be used between the two parts to prevent unwanted rotation of the post carrier 104 relative to the handle. This may be desirable for various asymmetric stud designs, e.g. a hinged hoop earring.

Similar to the post carrier 104, the nut carrier 106 is disposed to translate in a second channel 114 within the handle 102 of the body piercing instrument 100. Here also, the shown embodiment employs a cylindrical hollow (the second channel 114) and matching cylindrical shape (the nut carrier 106), however, any other guide mechanism and/or keyway may also be used. In this case, the nut carrier 106 carries the nut 118, the portion of the piercing ornament which covers the sharp post 108 at the completion of the piercing procedure. The arrangement of the nut carrier 106 and the second channel 114 is such that the carried nut 118 can translate in opposition to the post 108 of the post carrier 104. The guided opposing motion of the post carrier 104 and the nut carrier 106 allows the post 108 to be driven through the body part 116 and engage the nut 118 in a single operation.

Figure 2:
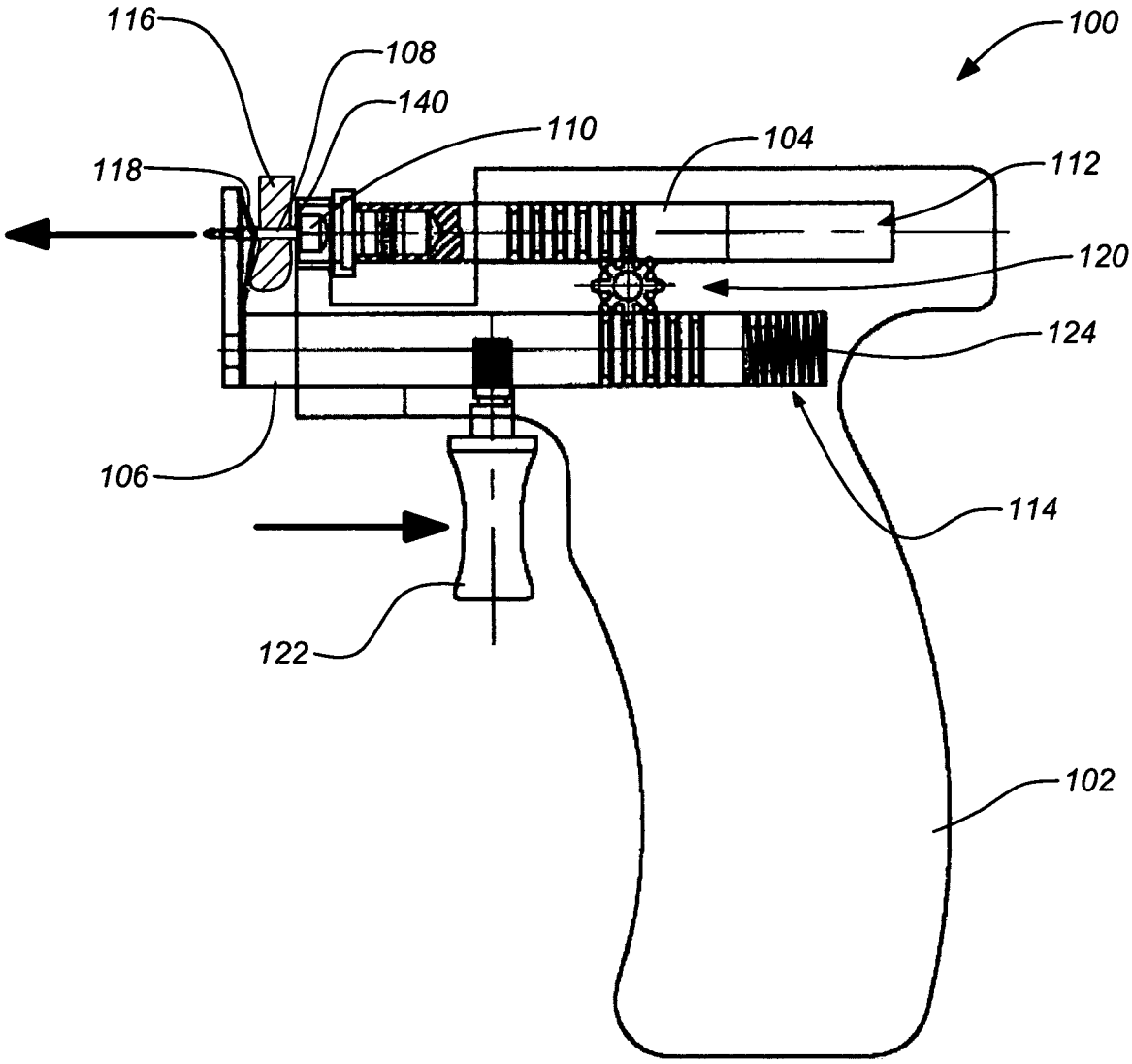
FIG. 2 illustrates an exemplary embodiment of a piercing instrument in a closed position with the post engaged with the nut according to the invention.

FIG. 2 illustrates an exemplary embodiment of the piercing instrument 100 in a closed position with the post 108 engaged with the nut 118 through the pierced body part 116 according to the invention. The post carrier 104 undergoes a linear translation carrying and driving the post 108 with the head 110 through the body part 116. At the same time, the nut carrier 106 is drawn towards the body part 116 on the side opposite the post 108 to engage the post 108 as it emerges through the body part 116.

Just as with the handle 102, both the post carrier 104 and the nut carrier 106 may be single units (e.g. single molded plastic pieces) or comprise multiple parts fastened together. For example, support of the post 108 and stud 110 and the nut 118 may require appropriate fittings or adapters which attach them to the post carrier 104 and the nut carrier 106, respectively, and also aid in maintaining sterility. In addition, in some embodiments a cartridge may be used which provides for attachment of both the post 108 and stud 110 and the nut 118 to the carriers 104, 106 and provides a sterile package in a single unit. (See section 3.0, hereafter.) For examples such cartridges, see e.g. U.S. Pat. No. 5,792,170 by Reil, issued Aug. 11, 1998 and U.S. Pat. No. 5,913,869 by Reil, issued Jun. 22, 1999, both of which are incorporated by reference herein. Embodiments of the invention and/or such cartridges can be adapted to operate together. In any case, all elements of the post carrier 104 and the nut carrier 106 are in a fixed relationship together and independent from the primary moving parts of the handle 102 in operation.

1.1 Synchronized Post And Nut Carrier

Importantly, embodiments of the invention employ a synchronizing mechanism 120 between the post carrier 104 and the nut carrier 106 to coordinate the opposing motion described above. The synchronizing mechanism 120 sets up simultaneous coordinated motion of both the post carrier 104 and the nut carrier 106 relative to the body piercing instrument (e.g. the platform or handle 102).

Figure 3:
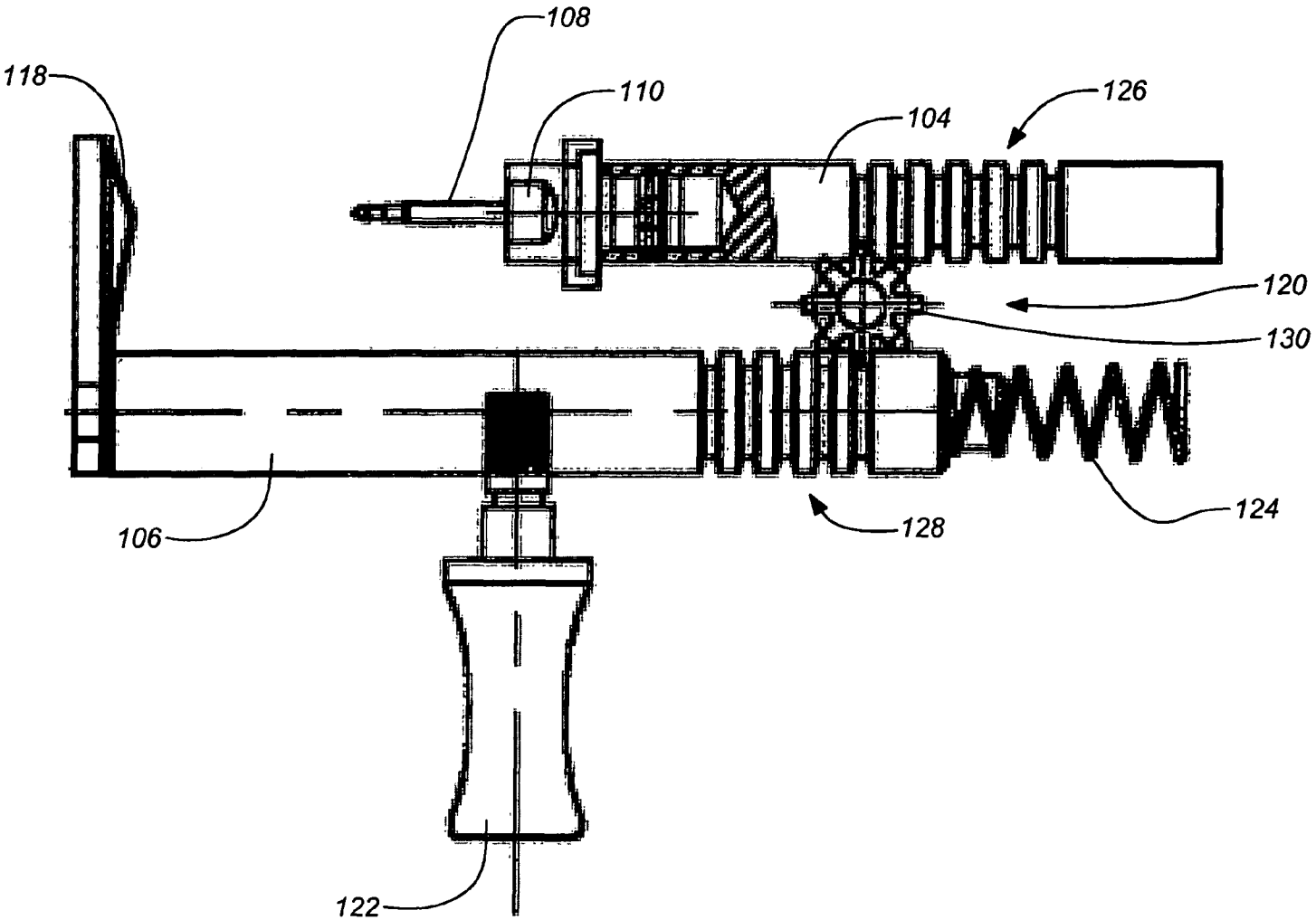
FIG. 3 illustrates the post carrier and the nut carrier in an open position synchronized by a gear.

FIG. 3 illustrates the post carrier 104 and the nut carrier 106 in an open position where the synchronizing mechanism comprises a gear 130 and racks 126, 128. The opposing motion of the post carrier 104 and the nut carrier 106 are synchronized by a gear 130. The gear 130, which is pinned to the handle 102 engages racks 126, 128 included in both the post carrier 104 and the nut carrier 106, respectively. The first channel 112 of the post carrier 104 and the second channel 114 of the nut carrier 106 are substantially parallel and disposed on opposite sides of the gear 130. Accordingly, simultaneous translation of both the post 108 with the post carrier 104 and the nut 118 with the nut carrier 106 towards the body part 116 is synchronized through counterclockwise rotation of the gear 130. Similarly, simultaneous translation of both the post 108 with the post carrier 104 and the nut 118 with the nut carrier 106 away from the body part 116 is synchronized through clockwise rotation of the gear 130.

Figure 4:
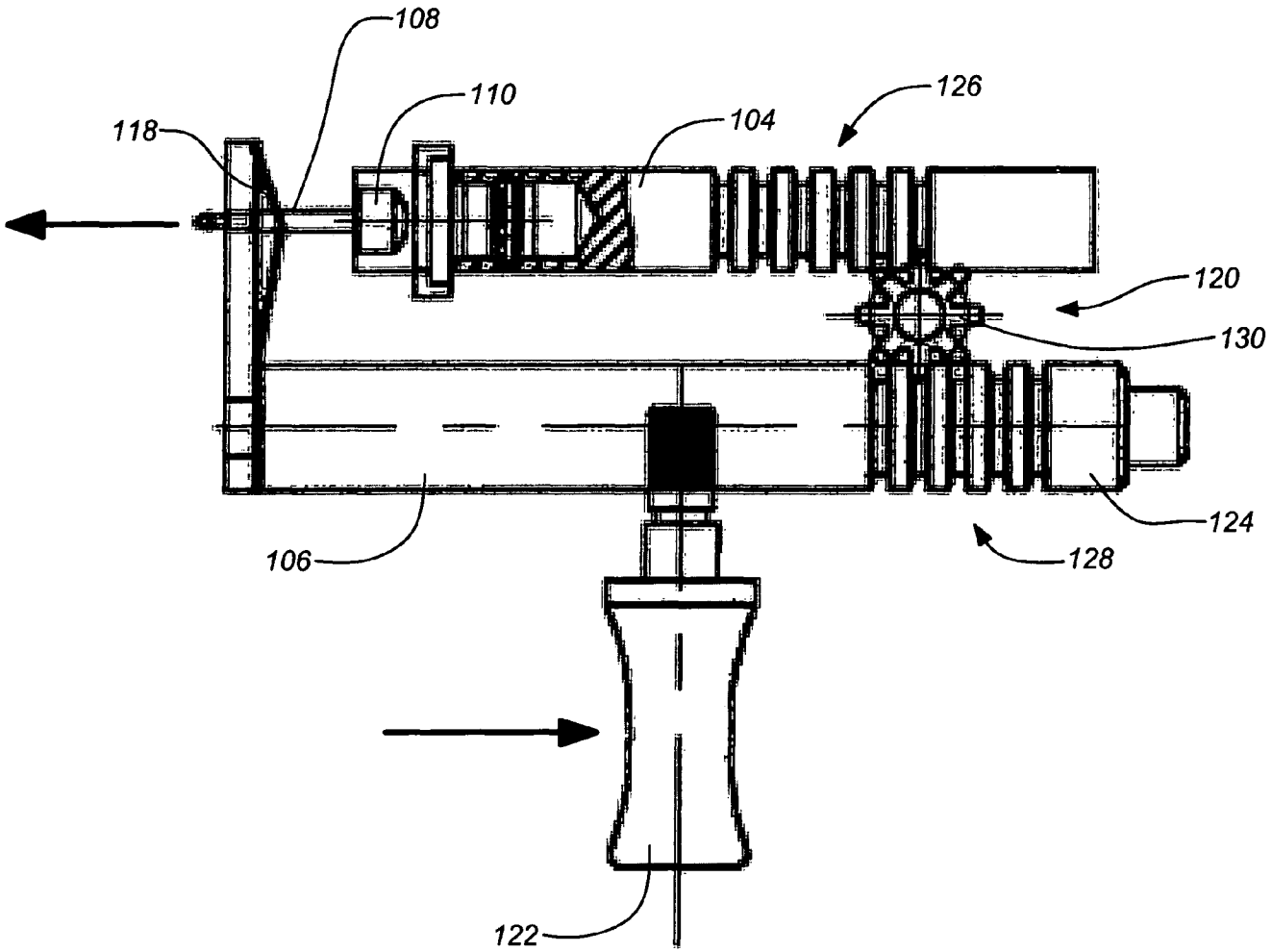
FIG. 4 illustrates the post carrier and the nut carrier in a closed position synchronized by a gear.

FIG. 4 illustrates the post carrier 104 and the nut carrier 106 in a closed position synchronized by a gear 130. In operation the synchronized mechanism is driven by pressure applied by the operator to a pull lever 122 (in the direction of the arrow shown near the pull lever 122) attached directly to the nut carrier 106. The nut 118 in the nut carrier 106 is thus forced towards the body part 116. The motion of the nut carrier 106 causes the rack 128 attached to the nut carrier to 106 drive the gear 130 in a counterclockwise rotation. Consequently, the counterclockwise rotation of the gear 130 drives the post carrier 104 to carry the post 108 in the direction opposite the motion of the nut 118 (in the direction of the arrow shown near the end of the post 108) until the two engage.

A spring 124 is used to apply a resisting force to translation of the post carrier 104 and the nut carrier 106, biasing piercing instrument 100 in the open position. See FIGS. 1-3. In the exemplary embodiment, the spring 124 is a compression spring disposed in the second channel 114 to act directly against the nut carrier 106. The spring 124 opposes the force applied by the operator on the pull level 122.

Figure 5:
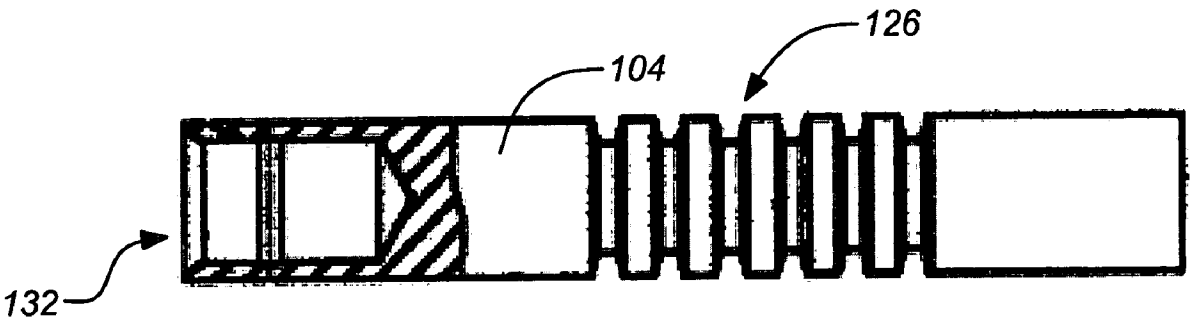
FIG. 5 illustrates an exemplary post carrier of an embodiment of the piercing instrument.

FIG. 5 illustrates an exemplary post carrier 104 of the piercing instrument 100. The post carrier 104 is cylindrical in shape to match the first channel 112 in the handle 102 of the piercing instrument 100. The gear rack 126 is formed by a series of circumferential grooves in the surface of the post carrier 104. The grooves are properly spaced to mesh with the teeth of the gear 130. At the end of the post carrier 104 is the attachment point 132 for the post portion of the piercing ornament. In the exemplary embodiment, the attachment point 132 comprises an internal cylindrical snap fitting that can receive a matching stud carrier. Further embodiments of the invention may incorporate any other type of fitting that serves to couple the post portion of the piercing ornament to the post carrier 104 in a manner that provides a secure, but releasable, holding.

Figure 6:
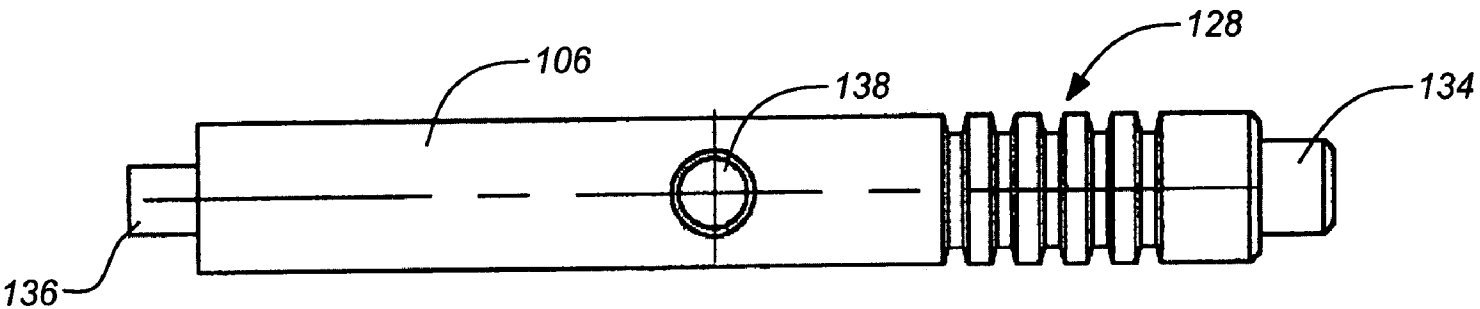
FIG. 6 illustrates an exemplary nut carrier of an embodiment of the piercing instrument.

FIG. 6 illustrates an exemplary nut carrier 106 of the piercing instrument 100. Like the post carrier 104, the nut carrier 106 is cylindrical in shape to match the second channel 114 in the handle 102 of the piercing instrument 100. The nut carrier 106 also has a gear rack 128 formed by a series of circumferential grooves in its surface, spaced to engage the teeth of the gear 130. The nut carrier 106 also includes a spring stop 134 at one end. The spring stop 134 serves as a seat for the spring 124 in the second channel 114. The spring stop 134 impacts the rear of the second channel 114 and prevents the spring 124 from being crushed when the pull lever 122 is drawn. The nut carrier 106 also includes the attachment point 138 for the pull lever 122. In this example, the attachment point 138 comprises a threaded hole which mates to a threaded end of the pull lever 122. At the other end of the nut carrier 106 is the attachment point 136 for the nut portion of the piercing ornament. In the exemplary embodiment, the attachment point 136 comprises a press fit end fitting. The nut 118 is easily replaced in the end fitting. However, any other type of fitting that serves to couple the nut portion of the piercing ornament to the nut carrier 106 in a manner that provides a secure, but releasable, holding may also be used.

1.2 Stabilizing Surface

Referring back to FIGS. 1 and 2, another important feature for some embodiments of piercing instrument 100 is a stabilizing surface 140 that can be used with the device. The stabilizing surface 140 is attached to the body (e.g. handle 102) of the piercing instrument 100 and disposed against a body part 116 to be pierced in operation. Because both the post carrier 104 and the nut carrier 106 both move relative to the handle 102, and therefore the stabilizing surface 140, operation of the piercing instrument 100 can be stabilized through contact of the surface 140 with the body part 116 as the piercing is performed.

In addition, because the stabilizing surface can be placed directly against the body part 116 to be pierced, the precise location of the piercing can be determined and maintained throughout the operation. In the exemplary embodiment, the post carrier 104 supports the post 108 to be driven through a passage in the stabilizing surface 140 to engage the nut 118 carried by the nut carrier 106. The passage in the stabilizing surface 140 identifies the precise location of the piercing. Furthermore, because operation of the device presents a smooth two-way motion of both the post carrier 104 and the nut carrier 106, accurate positioning of the piercing is more certain. Many previous piercing instruments operate with a snapping action that may cause errors when operated by less skillful technicians.

2.0 Alternate Embodiments

It is important to note that embodiments of the invention are not limited to employing a single gear 130 as the synchronizing mechanism 120. Various other mechanical systems can also be employed to synchronize the motion between the post carrier 104 and the nut carrier 106 and provide the two-way motion. For example, more than one gear 130 can be used in a gear train of some type which operates between the post carrier 104 and the nut carrier 106. Employing a gear train would enable piercing instrument designs with different ratios between the translation distances of the post carrier 104 and the nut carrier 106. Entirely different synchronizing mechanisms 120 are also possible.

Figure 7:
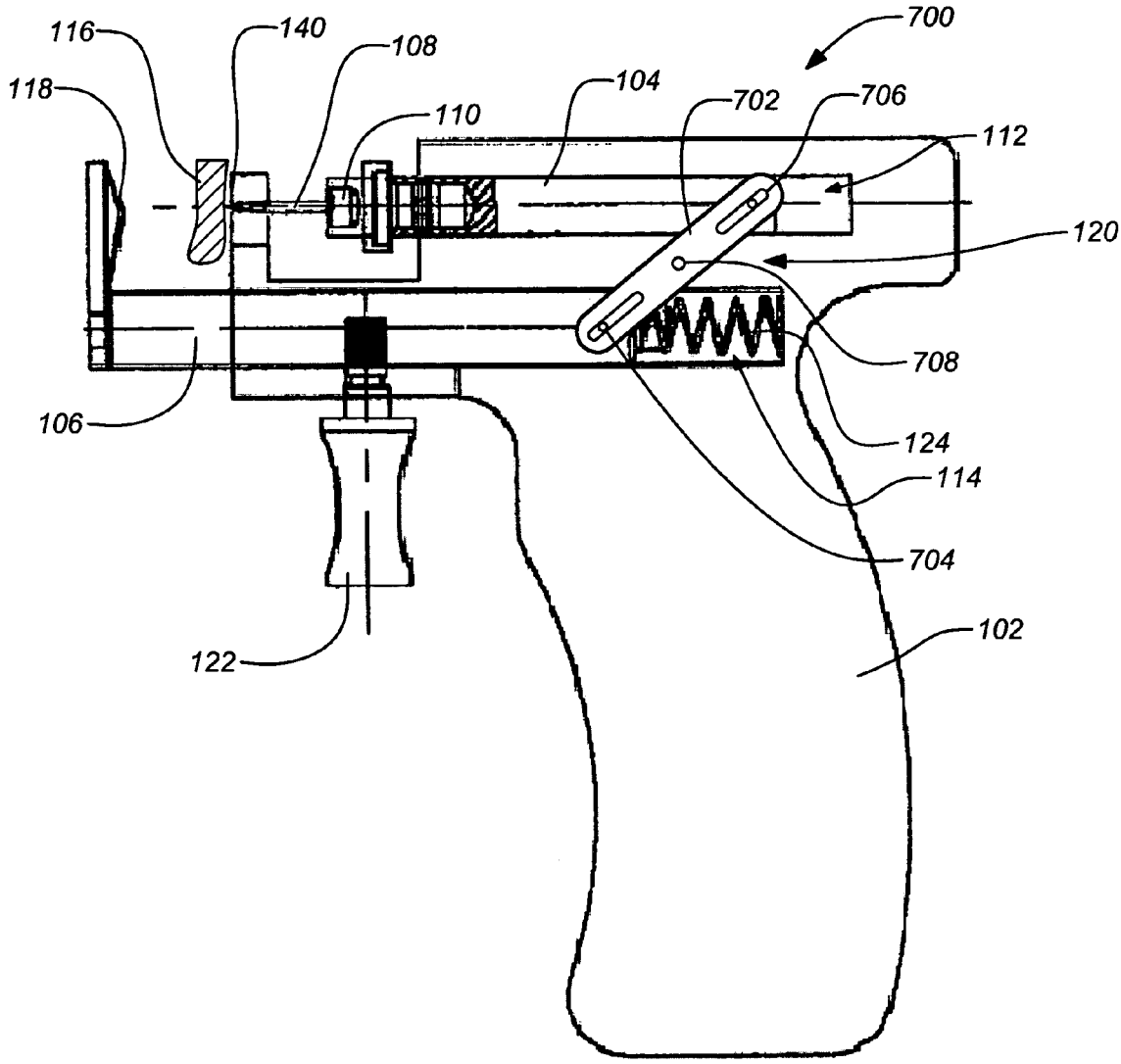
FIG. 7 illustrates an exemplary embodiment of a piercing instrument with a synchronizing linkage in an open position.

FIG. 7 illustrates an exemplary embodiment of a piercing instrument 700 where the synchronizing mechanism 120 comprises a linkage 702. In this embodiment, the linkage 702 replaces the gear 130 and racks 126, 128 employed in FIGS. 1-6. The piercing instrument 700 is shown in the open position. In this case, the linkage 702 is pinned to the handle 102 at a pin joint 708. The linkage 702 is also coupled to the post carrier 104 and the nut carrier 106 with separate slider joints 704, 706 engaged to the linkage 702.

Figure 8:
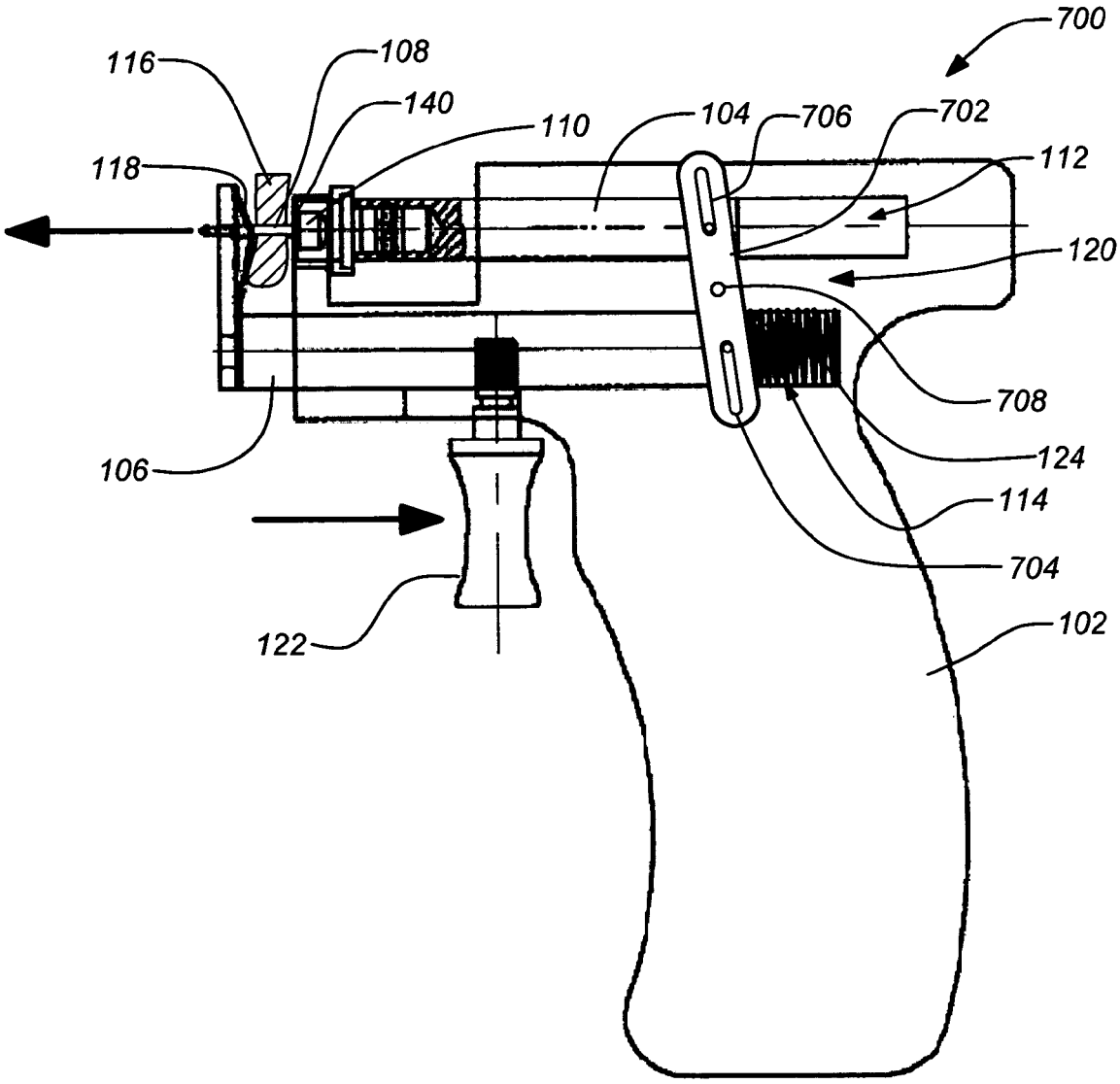
FIG. 8 illustrates an exemplary embodiment of a piercing instrument with a synchronizing linkage in an closed position.

FIG. 8 illustrates an exemplary embodiment of a piercing instrument 700 where the synchronizing mechanism 120 comprises a linkage 702. Here, the piercing instrument 700 is shown in a closed position after the post 108 has pierced the body part 116 and engaged the nut 118. In operation the translation of the nut carrier 106, effected by the operator applying force to the pull lever 122 causes counterclockwise rotation of the linkage 702 about the pin joint 708. The rotation of the linkage 702 drives the post carrier 104 forward on the opposing side of the linkage 702. The slider joints 704, 706 of the nut carrier 706 and post carrier 704, respectively, allow for free movement of the linkage 702. The other components and operation of this piercing instrument 700 are substantially identical to the piercing instrument 100; only the synchronizing mechanism 120 is different.

The foregoing examples illustrate some variants of the synchronizing mechanism 120 of a piercing instrument according to the present invention. Many other synchronizing mechanisms 120 may also be developed by those skilled in the art that are consistent with the novel aspects and within the scope of the present invention.

3.0 Cartridge for Two-Way Motion Piercing Instrument

Figure 9:
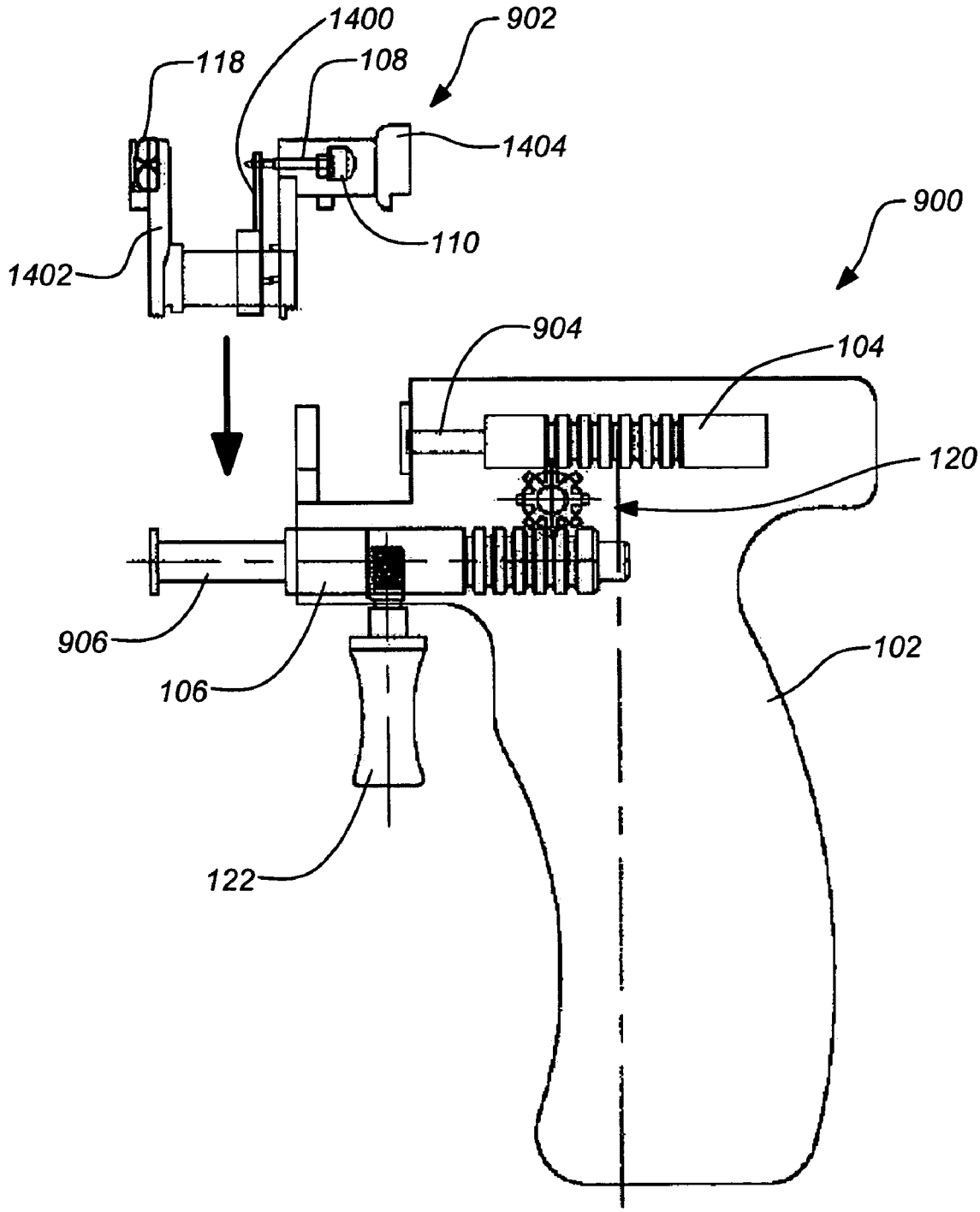
FIG. 9 illustrates an exemplary embodiment of a piercing instrument and a separable piercing ornament cartridge.

FIG. 9 illustrates an exemplary embodiment of a piercing instrument 900 and a separable piercing ornament cartridge 902. The basic components and features of the instrument 900 are generally the same as those described in the previous piercing instrument 100 of FIGS. 1-6. However, note that FIGS. 9-13 are somewhat simplified; some elements (e.g. the channels 112, 114 and the spring 124) are not explicitly shown. In addition, the instrument 900 can modified in the same manner as the previously described instruments 100, 700. For example, although the instrument 900 is shown with a gear 130 to provide the coordinated opposing motion, the instrument can alternately employ an any suitable synchronizing mechanism 120, such as the linkage 702 shown in the piercing instrument 700 of FIGS. 7 and 8. Also, as with the previously described embodiments, here the handle 102 provides a stable platform for manual operation by an operator. The instrument 900 includes the primary moving parts of a post carrier 104 and a nut carrier 106 disposed to translate in opposition with one another within the handle 102.

In this instrument 900, however, the nut 118 and post 108 and stud 110 are not individually attached to the nut carrier 106 and post carrier 104. Instead, the nut 118 and post 108 and stud 110 are all carried in an integral cartridge 902 which is loaded into the piercing instrument 900 before use in the direction of the arrow shown in FIG. 9. Accordingly, the post carrier 104 and the nut carrier 106 do not include the fittings which actually hold the post 108 and stud 110 and nut 118 as with the previous embodiments. In this case, the post carrier 104 includes a pin 904 to drive the post 108 and stud 110 in the cartridge 902 and the nut carrier 106 includes a cradle 906 to draw the nut 118 in the cartridge 902. Both the pin 904 and cradle 906 are generally cylindrical, however, keyways and/or other features can be included in them to engage the cartridge 902. Similarly, the handle 102 can include features which engage the cartridge 902, particularly when the cartridge 902 is operated to stabilize the piercing process. For example, snap fit features can be employed between the cartridge 902 and the handle 102 and/or carriers 104, 106.

Figure 10:
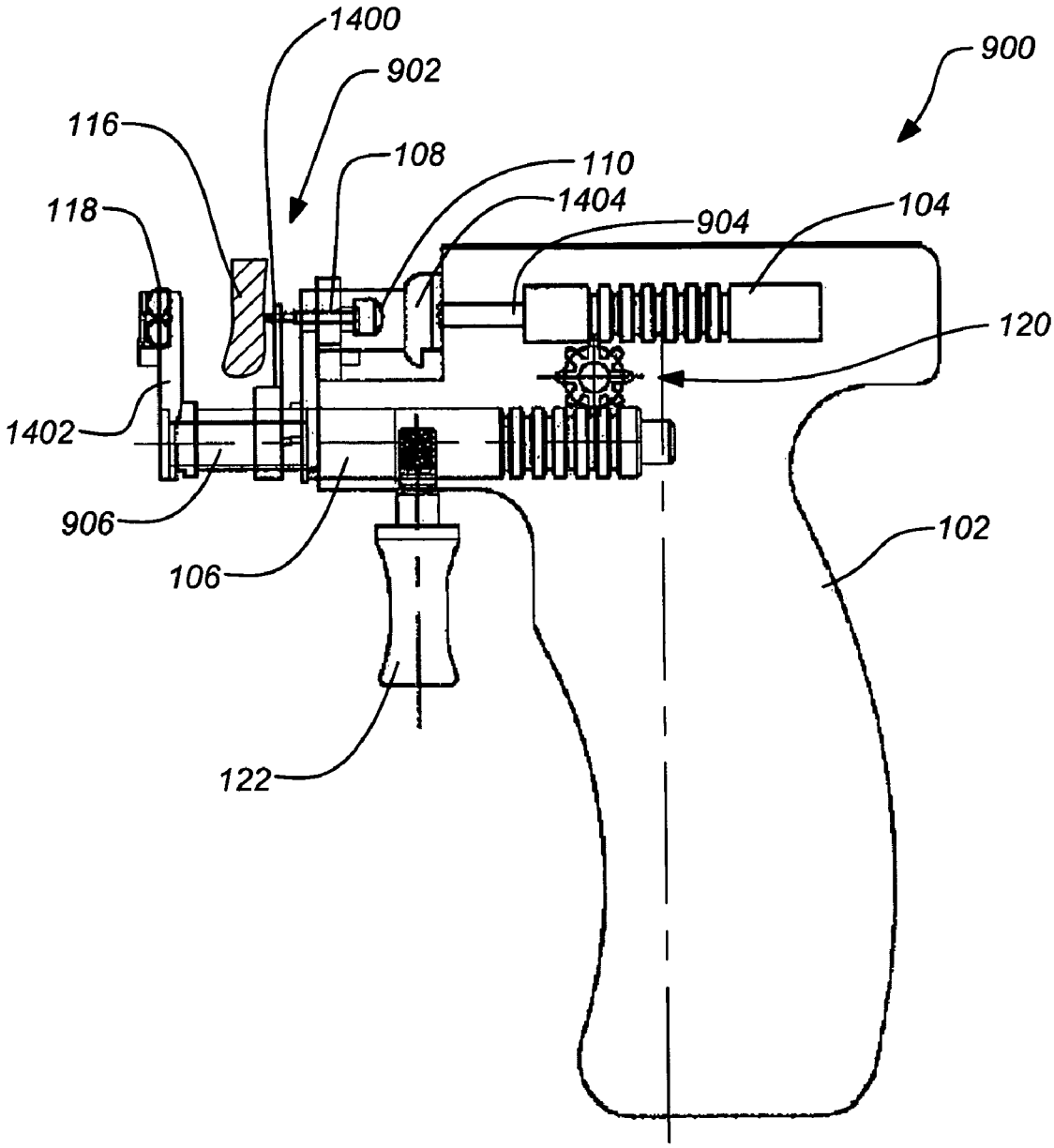
FIG. 10 illustrates an exemplary embodiment of a piercing instrument with a piercing ornament cartridge installed in an open position before piercing.

FIG. 10 illustrates the piercing instrument 900 with the cartridge 902 installed in an open position before piercing. The body part 116 to be pierced is shown in position between the nut 118 and the post 108 of the loaded cartridge 902 against a stabilizing surface 1400 of the cartridge 902.

Figure 11:
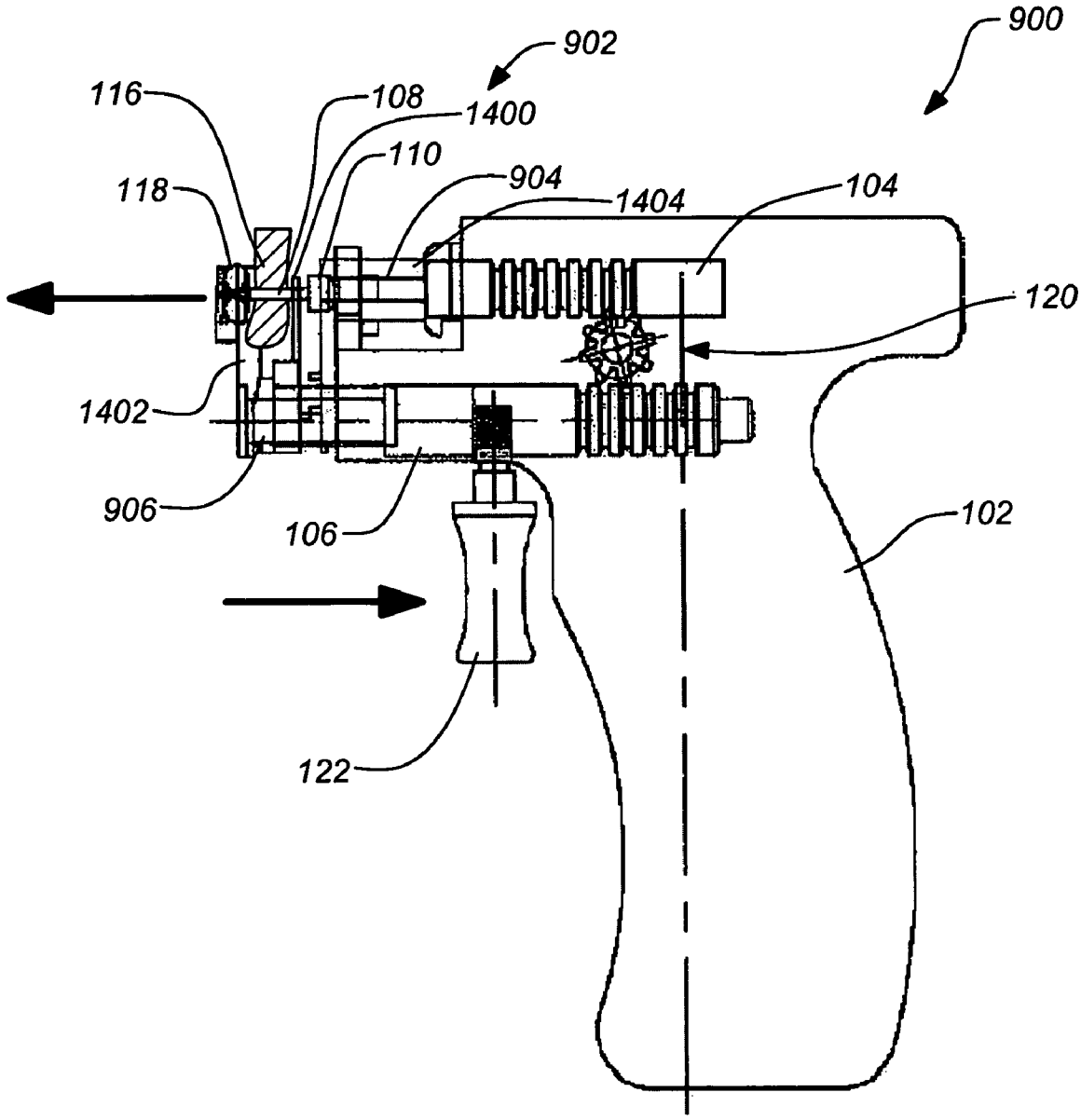
FIG. 11 illustrates an exemplary embodiment of a piercing instrument with a piercing ornament cartridge installed in a closed position.

FIG. 11 illustrates the piercing with the instrument 900 and cartridge 902. Force is applied to the pull lever 122 (indicated by the near arrow) by operator. This causes the nut carrier 106 to draw the cradle 906 in the same direction as the applied force. In turn, the cradle 906 draws the cartridge nut carrier 1402 which supports the nut 118 in the same direction, moving the cartridge nut carrier 1402 relative the stabilizing surface 1400 of the cartridge 902. Thus, the nut 118 is drawn towards the body part 116. Simultaneously, the synchronizing mechanism 120 (e.g., a gear or linkage) drives the post carrier 104 in the opposing direction. The pin 904 of the post carrier 104 presses on the stud 110 and drives the post 108 out of the cartridge post carrier 1404 relative to the stabilizing surface 1400 of the cartridge 902. The post 108 pierces the disposed body part 116 and engages the nut 118 being simultaneously drawn towards the body part 116 on the opposite side.

Figure 12:
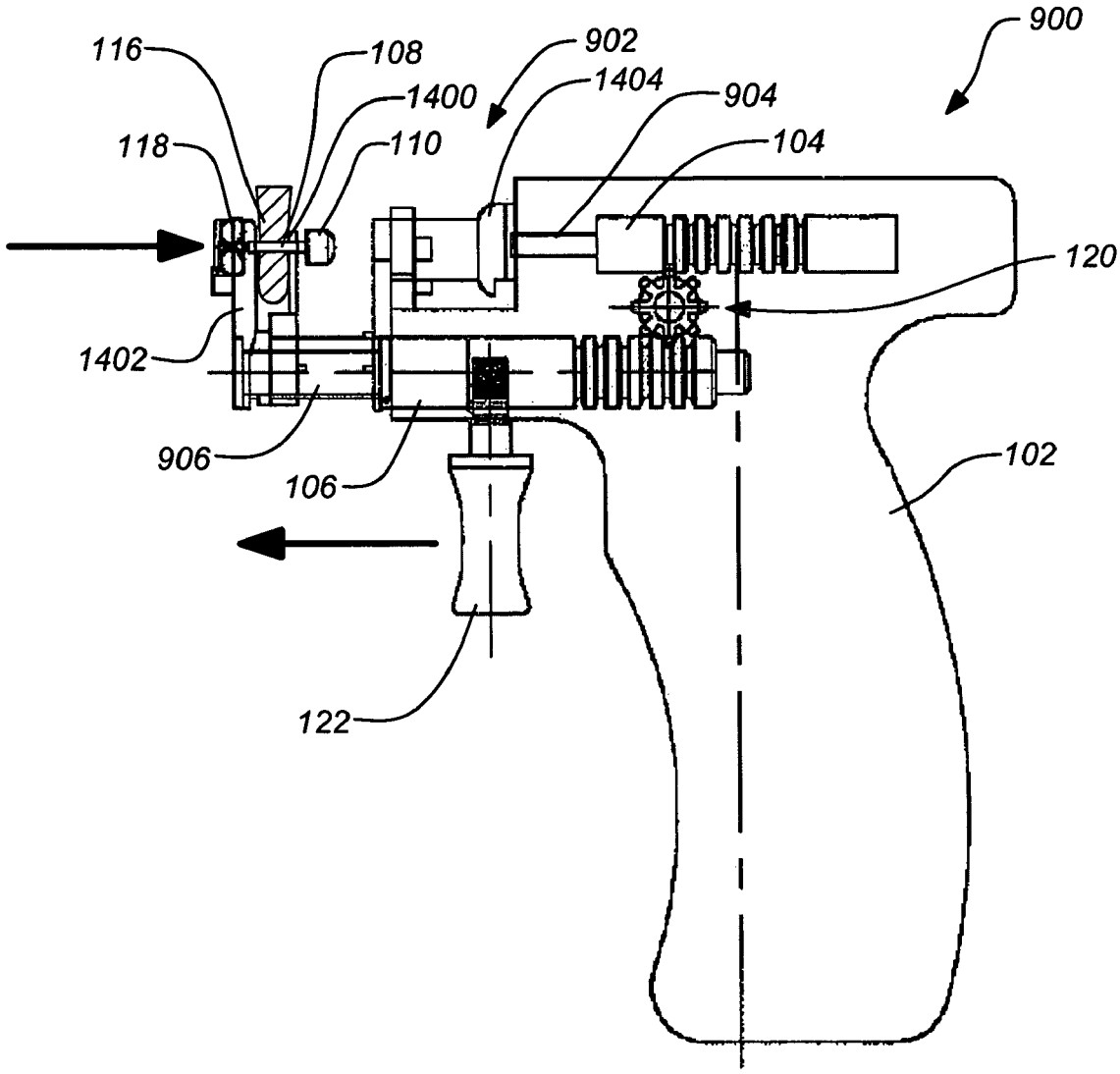
FIG. 12 illustrates an exemplary embodiment of a piercing instrument with a piercing ornament cartridge installed in an open position after piercing.

FIG. 12 illustrates the instrument 900 and cartridge 902 after piercing. After the operator releases the pull lever 122, opposing force from the spring 124 (not shown) acts against the nut carrier 106 to push the nut carrier 106 back to the open position. As this happens, the stabilizing surface 1400 moves with the nut carrier 106, cradle 906 and cartridge nut carrier 1402. This return motion of the stabilizing surface 1400 allows the stabilizing surface 1400 to maintain support of post 108 as the instrument 900 is opened to allow the stud 110 to be entirely free from the cartridge post carrier 1404. In addition, the change in the configuration of the cartridge 902 (i.e. movement of the stabilizing surface 1400) prevents the cartridge from being reloaded which would not be a sterile practice.

The return motion of the stabilizing surface 1400 can be accomplished in a number of ways. For example the piercing operation (FIG. 11) of the instrument 900 and cartridge 902 can cause a features between the stabilizing surface 1400 and the cartridge nut carrier 1402 to engage which will attach the stabilizing surface 1400 to the cartridge nut carrier 1402. Alternately (or in addition), the engagement of the post 108 and nut 118 may provide enough force to pull the stabilizing surface 1400 by the stud 110. A frangible joint 1406 can be provided between the cartridge post carrier 1404 and the stabilizing surface 1400 to break during the return motion of the stabilizing surface 1400.

Figure 13:
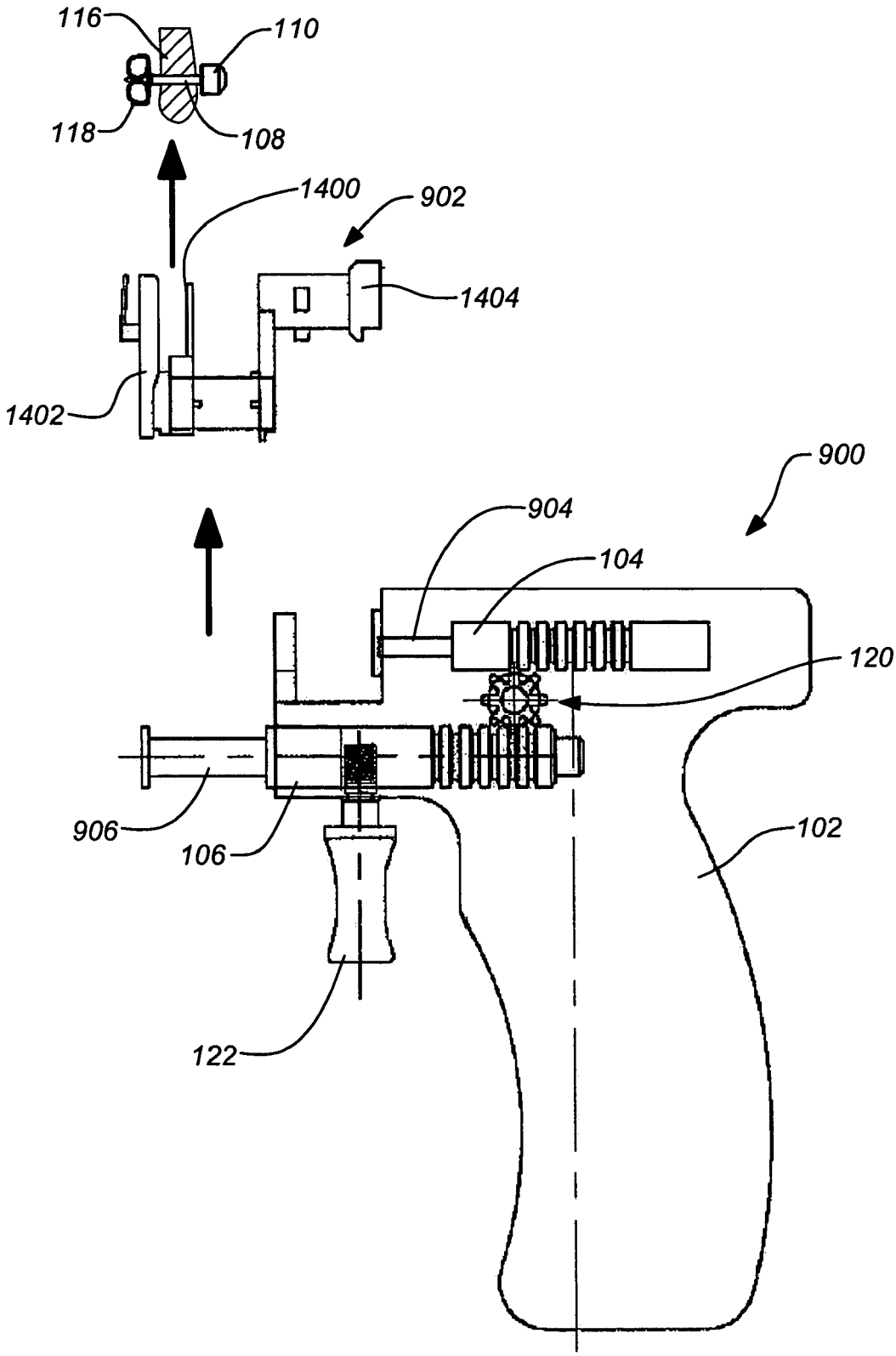
FIG. 13 illustrates removal of the piercing ornament and cartridge after piercing with an exemplary embodiment of a piercing instrument.

FIG. 13 illustrates removal of the pierced body part 116 and cartridge 902 after piercing with the piercing instrument 900. The nut 118, post 108 and stud 110 together slip free from the cartridge nut carrier 1402 and stabilizing surface 1400 in an upward direction. The cartridge 902 is then disengaged and removed from the piercing instrument 900 and may be discarded. The piercing instrument 900 may then be reloaded with another cartridge 902.

Figure 14:
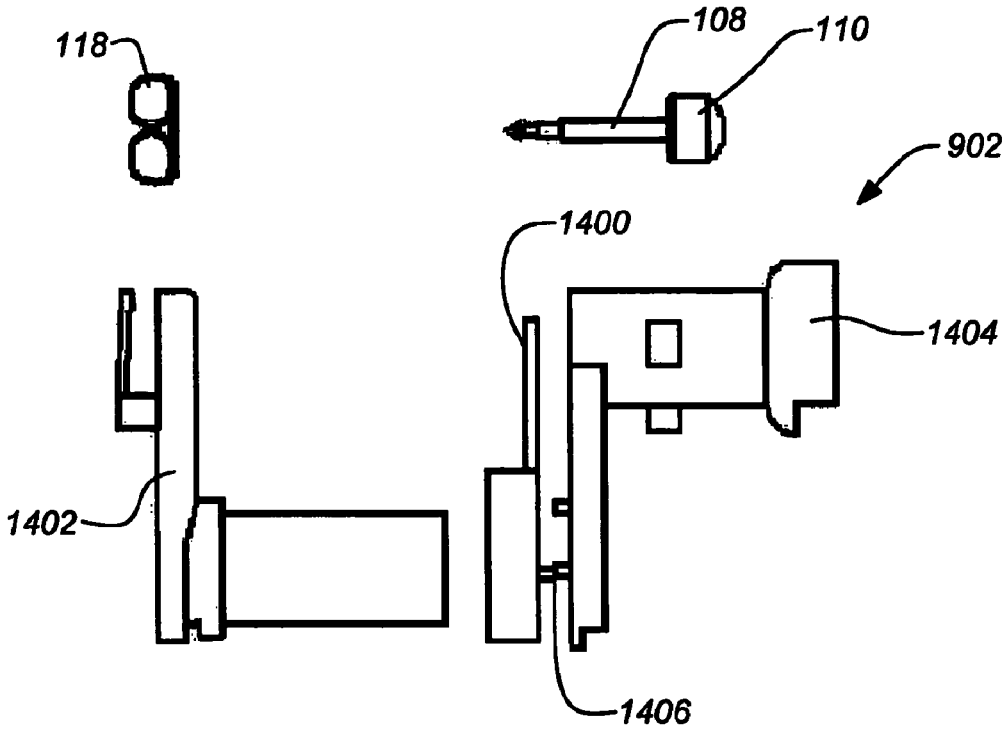
FIG. 14 illustrates an exemplary embodiment of a piercing ornament cartridge for use in a two-way motion piercing instrument.

FIG. 14 illustrates an exemplary embodiment of a piercing ornament cartridge 902 for use in the two-way motion piercing instrument 900. The cartridge 902 is designed to be loaded and operated in a piercing instrument 900. The cartridge 902 holds an earring ornament including a nut 118 and a post 108. The cartridge 902 also includes a stabilizing support 1400. In operation the nut 118 and post 108 both translate relative to the stabilizing support 1400 such that the post 108 engages the nut 118. The nut 118 and post 108 are carried by a cartridge nut carrier 1402 and cartridge post carrier 1404, respectively. As described above, operating the cartridge 902 drives the post 108 out of the cartridge post carrier 1404 to pierce a body part 116. Operating the cartridge 902 also moves the cartridge nut carrier 1402 to draw the nut 118 toward a body part 116 to engage the post 108.

Figure 15:
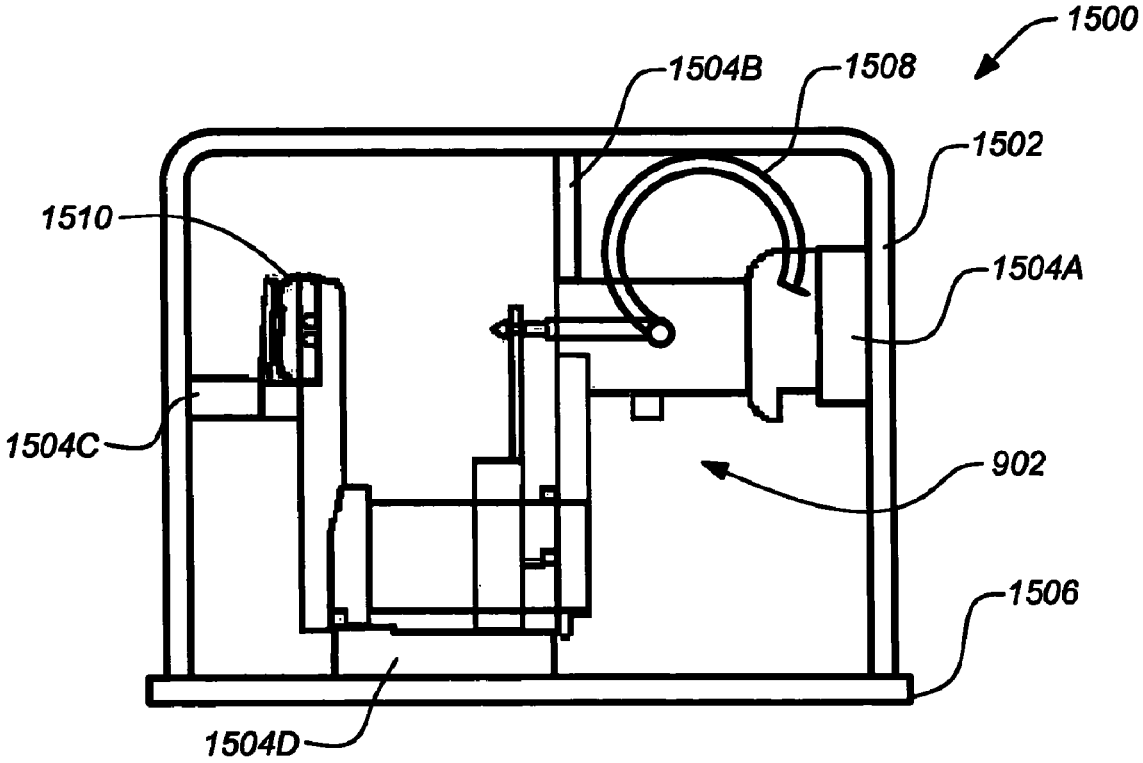
FIG. 15 illustrates an exemplary embodiment of a piercing ornament cartridge for use in a two-way motion piercing instrument in a sterile package.

FIG. 15 illustrates an exemplary embodiment of a piercing ornament cartridge 902 for use in a two-way motion piercing instrument 900 enclosed in a sterile package 1500. The sterile package 1500 includes an enclosure 1502 which may be transparent plastic to readily reveal the ornament type and design without requiring it to be opened. The sterile cartridge 902 is disposed within the enclosure 1502 and a base 1506 of the package 1500 is hermetically sealed to the lip of the enclosure 1502. The cartridge 902 may then be transported and stored within the sterile package 1500. The package 1500 includes integral standoffs 1504A-1504D extending from the enclosure 1502 and base 1506 to support the cartridge 902.

The cartridge 902 can include a variety of piercing ornaments. For example, in some ornaments a stud 110 is fixed to the post 108. Alternately, a hinged hoop 1508 may be attached to the post 108. The nut 118 of the piercing ornament may be a standard nut which allows the sharp end of the post 108 to poke through the back side when engaged. Alternately, the nut 1510 can include a shield which blocks the sharp end of the post 108 after the post 108 engages the nut 1510. Of course, these various piercing ornaments and others may also be used in embodiments of the piercing instrument 100, 700 which do not employ the cartridge 902.

4.0 Exemplary Method of Piercing

Figure 16:
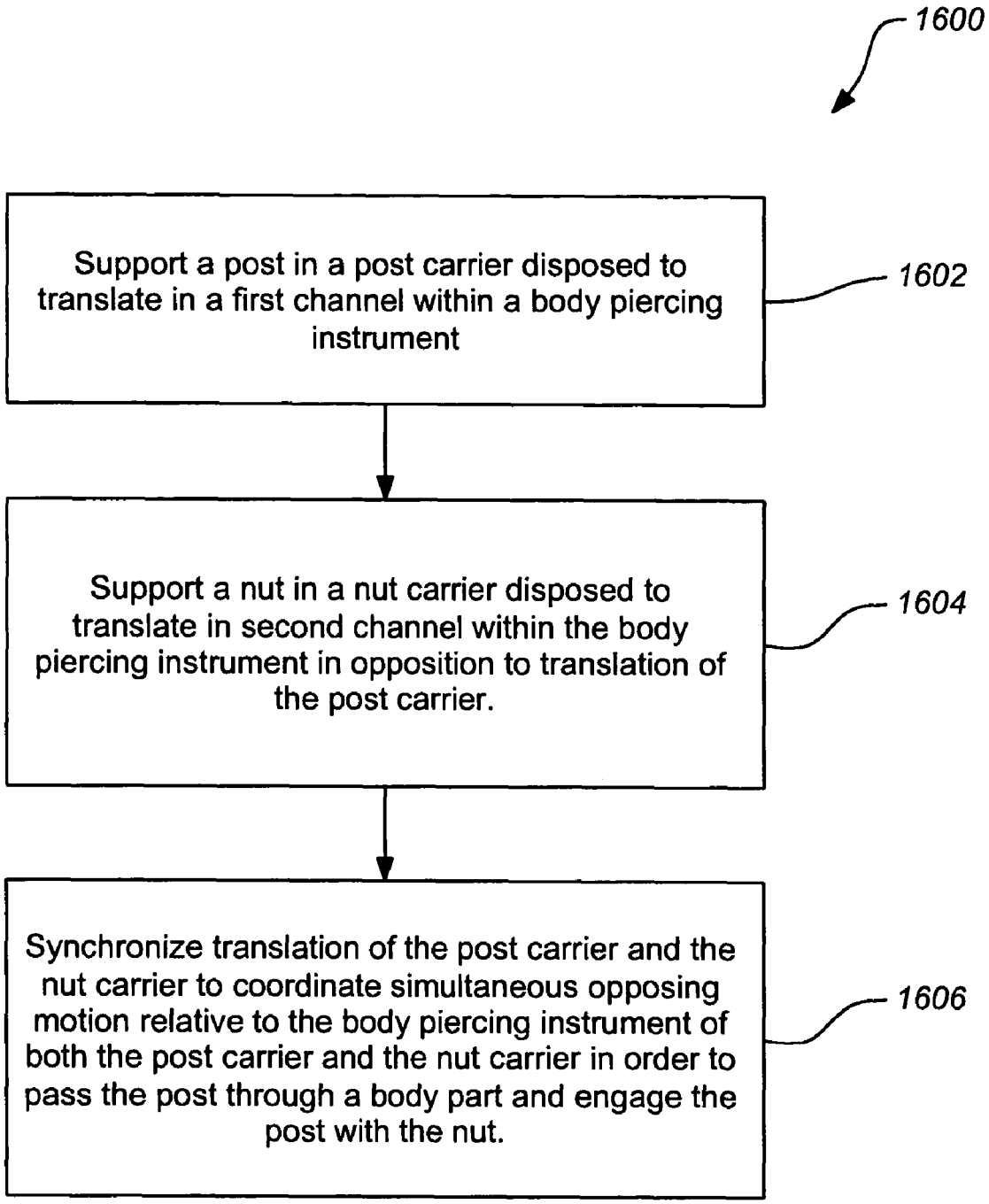
FIG. 16 is flowchart illustrating an exemplary method of piercing according to the invention.

FIG. 16 is flowchart illustrating an exemplary method 1600 of piercing according to the invention. First at step 1602, a post is supported in a post carrier disposed to translate in a first channel within a body piercing instrument. Next at step 1604, a nut is supported in a nut carrier disposed to translate in second channel within the body piercing instrument in opposition to translation of the post carrier. Finally at step 1606, translation of the post carrier and the nut carrier is synchronized to coordinate simultaneous opposing motion relative to the body piercing instrument of both the post carrier and the nut carrier in order to pass the post through a body part and engage the post with the nut. Further embodiments of the method 1600 can be modified consistent with the apparatus embodiments described above.

This concludes the description including the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

It is intended that the scope of the invention be limited not by this detailed description, but rather by the claims appended hereto. The above specification, examples and data provide a complete description of the manufacture and use of the apparatus and method of the invention. Since many embodiments of the invention can be made without departing from the scope of the invention, the invention resides in the claims hereinafter appended.

What is claimed is:

1. A body piercing instrument, comprising:

a post carrier supporting a post, the post carrier disposed to translate in a first channel within the body piercing instrument;

a nut carrier supporting a nut, the nut carrier disposed to translate in a second channel within the body piercing instrument in opposition to translation of the post carrier;

a synchronizing mechanism between the post carrier and the nut carrier to coordinate opposing motion of both the post carrier and the nut carrier simultaneously;

a handle for manual manipulation and support of the piercing instrument, where the first channel and second channel are disposed within the handle; and a pull lever attached directly to the nut carrier;

wherein only the synchronizing mechanism drives the post carrier with opposing motion to the nut carrier and wherein the pull lever is drawn by hand such that the synchronizing mechanism is driven by pressure applied to the pull lever attached directly to the nut carrier and thereby causing the nut carrier to translate and the synchronizing mechanism to drive the post carrier in opposition to the nut carrier.

2. The body piercing instrument of claim 1, further comprising a stabilizing surface to be disposed against a body part to be pierced, the post carrier and the nut carrier both movable relative to the body part.

3. The body piercing instrument of claim 2, wherein the post carrier supports the post to be driven through a passage in the stabilizing surface to engage the nut carried by the nut carrier.

4. The body piercing instrument of claim 1, wherein the synchronizing mechanism comprises a linkage and the post carrier and the nut carrier each include a joint engaged to the linkage.

5. The body piercing instrument of claim 1, further comprising a spring applying a resisting force to translation of the nut carrier and the post carrier.

6. The body piercing instrument of claim 1, wherein the post carrier is loadable with a hinged hoop earring.

7. The body piercing instrument of claim 1, wherein the nut comprises a shield blocking a sharp end of the post after the post engages the nut.

8. The body piercing instrument of claim 1, wherein the nut carrier and the post carrier are loadable with a cartridge including a nut and a post.

9. The body piercing instrument of claim 8, wherein the cartridge is loaded with a hinged hoop earring.

10. The body piercing instrument of claim 8, wherein the cartridge is sterile packaged.

11. The body piercing instrument of claim 1, wherein the synchronizing mechanism comprises a gear and the post carrier and the nut carrier each include a rack, each rack engaging the gear.

12. The body piercing instrument of claim 11, wherein the first channel of the post carrier and the second channel of the nut carrier are substantially parallel and disposed on opposite sides of the gear.

13. The body piercing instrument of claim 1, wherein the post carrier and the first channel and the nut carrier and the second channel, respectively, have a substantially cylindrical engagement.

14. A method of body piercing, comprising the steps of supporting a post in a post carrier disposed to translate in a first channel within a body piercing instrument;

supporting a nut in a nut carrier disposed to translate in second channel within the body piercing instrument in opposition to translation of the post carrier, and synchronizing translation of the post carrier and the nut carrier with a synchronizing mechanism to coordinate simultaneous opposing motion relative to the body piercing instrument of both the post carrier and the nut carrier in order to pass the post through a body part and engage the post with the nut;

wherein only the synchronizing mechanism drives the post carrier with opposing motion to the nut carrier, the body piercing instrument further comprises a handle for manual manipulation and support of the piercing instrument and the first channel and second channel are disposed within the handle and wherein a pull lever attached directly to the nut carrier is drawn by hand such that the synchronizing mechanism is driven by pressure applied to the pull lever attached directly to the nut carrier and thereby causing the nut carrier to translate and the synchronizing mechanism to drive the post carrier in opposition to the nut carrier.

15. The method of claim 14, further comprising stabilizing the body part to be pierced against a stabilizing surface such that the post carrier and the nut carrier both move relative to the body part.

16. The method of claim 15, wherein the post carrier supports the post to be driven through a passage in the stabilizing surface to engage the nut carried by the nut carrier.

17. The method of claim 14, wherein the synchronized translation of the post carrier and the nut carrier is provided by a linkage and the post carrier and the nut carrier each include a joint engaged to the linkage.

18. The method of claim 14, wherein a spring applies a resisting force to translation of the nut carrier and the post carrier.

19. The method of claim 14, further comprising loading the post carrier with a hinged hoop earring.

20. The method of claim 14, wherein the nut comprises a shield blocking a sharp end of the post after the post engages the nut.

21. The method of claim 14, further comprising loading the nut carrier and the post carrier with a cartridge including the nut and post.

22. The method of claim 21, wherein the cartridge is loaded with a hinged hoop earring.

23. The method of claim 21, wherein the cartridge is sterile packaged.

24. The method of claim 14, wherein the synchronized translation of the post carrier and the nut carrier is provided by a gear and the post carrier and the nut carrier each include a rack, each rack engaging the gear.

25. The method of claim 24, wherein the first channel of the post carrier and the second channel of the nut carrier are substantially parallel and disposed on opposite sides of the gear.

26. The method of claim 14, wherein the post carrier and the first channel and the nut carrier and the second channel, respectively, have a substantially cylindrical engagement.

27. A body piercing instrument, comprising:

a post carrier means supporting a post, the post carrier means disposed to translate in a first channel within the body piercing instrument;

a nut carrier means supporting a nut, the nut carrier means disposed to translate in second channel within the body piercing instrument in opposition to translation of the post carrier means;

a synchronizing mechanism means between the post carrier means and the nut carrier means to coordinate opposing motion of both the post carrier means and the nut carrier means simultaneously;

a handle means for manual manipulation and support of the piercing instrument, where the first channel and second channel are disposed within the handle means; and a pull lever means attached directly to the nut carrier means;

wherein only the synchronizing mechanism means drives the post carrier means with opposing motion to the nut carrier means and wherein the pull lever means is drawn by hand such that the synchronizing mechanism means is driven by pressure applied to the pull lever means attached directly to the nut carrier means and thereby causing the nut carrier means to translate and the synchronizing mechanism means to drive the post carrier means in opposition to the nut carrier means.

* * * * *